US008622328B2

(12) United States Patent
Matsumoto et al.

(10) Patent No.: US 8,622,328 B2
(45) Date of Patent: Jan. 7, 2014

(54) VERTICAL ROLLER MILL

(75) Inventors: Shinji Matsumoto, Tokyo (JP); Takashi Tsutsuba, Tokyo (JP); Koki Matsuzaki, Tokyo (JP); Sotaro Yamaguchi, Tokyo (JP); Yasuhiro Sueoka, Tokyo (JP); Kenichi Arima, Tokyo (JP); Tsugio Yamamoto, Tokyo (JP); Takuichiro Daimaru, Tokyo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/805,390

(22) PCT Filed: Aug. 22, 2011

(86) PCT No.: PCT/JP2011/068868

§ 371 (c)(1),
(2), (4) Date: Dec. 19, 2012

(87) PCT Pub. No.: WO2012/026422

PCT Pub. Date: Mar. 1, 2012

(65) Prior Publication Data

US 2013/0327861 A1 Dec. 12, 2013

(30) Foreign Application Priority Data

Aug. 27, 2010 (JP) ..... 2010-191304

(51) Int. Cl.
*B02C 19/00* (2006.01)

(52) U.S. Cl.
USPC ..... 241/119

(58) Field of Classification Search
USPC ..... 241/117–121; 209/139.2
See application file for complete search history.

(56) References Cited

U.S. PATENT DOCUMENTS 3,680,695 A * 8/1972 Yoshimori et al. ..... 209/139.2
5,819,947 A * 10/1998 Nardi et al. ..... 209/139.2

(Continued)

FOREIGN PATENT DOCUMENTS

JP 2-26682 1/1990
JP 10-230181 9/1998

(Continued)

OTHER PUBLICATIONS

International Search Report issued Oct. 4, 2011 in corresponding International Application No. PCT/JP2011/068868.
Written Opinion of the International Searching Authority issued Oct. 4, 2011 in corresponding International Application No. PCT/JP2011/068868 (with English translation).

*Primary Examiner* — Faye Francis
(74) *Attorney, Agent, or Firm* — Wenderoth, Lind & Ponack, L.L.P.

(57) ABSTRACT

In a vertical roller mill in which a fixed-type cyclone sorter is provided in a casing, the fixed-type cyclone sorter includes a conical member; a fixed-blade entrance window through which a solid-gas two-phase flow is introduced into the interior of the conical member; a flat plate-like fixed blade that causes the solid-gas two-phase flow to spiral; an inner cylinder into which pulverized coal is guided from the bottom end thereof toward the top end thereof by means of spiraling of the solid-gas two-phase flow; and a pulverized-coal exit through which the pulverized coal guided to the top end of the inner cylinder is guided outside the conical member, wherein the fixed blade is provided with a tip portion where a downward flow is increased for the solid-gas two-phase flow guided into the interior of the conical member from the fixed-blade entrance window.

4 Claims, 10 Drawing Sheets

(56) References Cited

U.S. PATENT DOCUMENTS

| | | | |
|---|---|---|---|
| 5,957,300 | A | 9/1999 | Nardi et al. |
| 2010/0236458 | A1 | 9/2010 | Otani et al. |
| 2012/0138718 | A1 | 6/2012 | Daimaru et al. |

FOREIGN PATENT DOCUMENTS

| | | |
|---|---|---|
| JP | 2000-51723 | 2/2000 |
| JP | 2011-104563 | 6/2011 |
| WO | 2009/041628 | 4/2009 |

* cited by examiner

FIG. 4

| | $L_1/L$ | $L_2/L$ | $\theta_1$ | $\theta_2$ | RATIO OF RESIDUE FOR 50 MESH (PROPORTION OF COARSE PARTICLES OF 300 μm OR LARGER) |
|---|---|---|---|---|---|
| | (-) | (-) | (deg.) | (deg.) | RATIO (RELATIVE TO CONVENTIONAL CASE) |
| CONVENTIONAL (RELATED ART) | - | - | 0 | 0 | 1.00 |
| EXAMPLE 1 | 0.24 | 0.50 | 19 | 16 | 0.76 |
| EXAMPLE 2 | 0.24 | - | 0 | 35 | 0.76 |

FIG. 5

| | $L_1/L$ | $L_2/L$ | $\theta_1$ | $\theta_2$ | RATIO OF MAXIMUM POWDER FINENESS (THOSE PASSING THROUGH 200 MESH) |
|---|---|---|---|---|---|
| | (-) | (-) | (deg.) | (deg.) | RATIO (RELATIVE TO CONVENTIONAL CASE) |
| CONVENTIONAL (RELATED ART) | - | - | 0 | 0 | 1.00 |
| EXAMPLE 1 | 0.24 | 0.50 | 19 | 16 | 1.03 |
| EXAMPLE 2 | 0.24 | - | 0 | 35 | 0.94 |

COMPARISON OF COARSE-PARTICLE SEPARATION CAPABILITY (RATIO OF PARTICLES REMAINING IN 50 MESH)

VERTICAL ROLLER MILL

TECHNICAL FIELD

The present invention relates to a vertical roller mill employed in, for example, a pulverized-coal-fired boiler or the like.

BACKGROUND ART

In a coal-fired boiler in the related art, for example, raw-material coal is input to a coal pulverizer, such as a vertical roller mill 10 shown in FIGS. 9 and 10, from a coal feeding pipe 14, and ground pulverized coal is used as fuel. Inside the vertical roller mill 10, a grinding roller 13, while rotating, revolves on a grinding table 12 installed in a casing 11 at a lower portion thereof.

The raw-material coal input to the vertical roller mill 10 is ground into pulverized coal by being crunched between the grinding table 12 and the grinding roller 13. Hot air jetted from a throat 15 disposed in the periphery of the grinding table 12 transports the pulverized coal by means of an airflow, while drying it, to a fixed-type sorter 20 disposed thereabove in the casing 11. Because gravitational sorting is performed at this time, in which large coarse particles having large particle sizes drop due to gravity and are returned onto the grinding table 12, the pulverized coal is repeatedly ground until a desired particle size is achieved.

After the primary sorting by means of the gravitational sorting, product pulverized-coal particles containing coarse particles are further sorted by the fixed-type sorter 20 disposed at the top of the grinding table 12. This type of sorter includes a rotating type and a type in which a fixed type and a rotating type are combined, in addition to the fixed-type sorter 20. Note that a rotating-type sorter performs sorting by means of collision with rotating blades and an inertial force, and it is known to have high sorting capability.

The pulverized coal transported by means of the airflow is dried by the hot air, and, in addition, it is sorted by passing through the fixed-type sorter 20. The sorted pulverized coal passes through a pulverized-coal exit 16 which communicates with the exterior above the casing 11 from the interior of the fixed-type sorter 20 and is transported to a boiler (not shown) by means of the airflow of transporting primary air.

The fixed-type sorter 20 is provided, at the top end of a cone 21, with numerous fixed-blade entrance windows 22 serving as openings at equal intervals in the circumferential direction. The fixed-blade entrance windows 22 are opening portions provided so as to penetrate through a wall surface that forms the cone 21 and serve as entrances and flow paths where the flow of the pulverized coal transported by the airflow (hereinafter, referred to as "solid-gas two-phase flow") passes through to flow into the interior of the cone 21. Fixed blades 23 corresponding to the individual fixed-blade entrance windows 22 are attached to the inner wall of the cone 21.

An inner cylinder 24 that forms a wall surface facing the fixed-blade entrance windows 22 and the fixed blades 23 is provided on the inner side of the cone 21. In order to cause the solid-gas two-phase flow to spiral, all fixed blades 23 are attached with an inclination in the same direction, that is, having an inclined angle with respect to a line extending in the radial direction toward the axial center of the cone 21. Therefore, by increasing or decreasing the inclination angle of the fixed blades 23, the intensity of the spiral flow can also be changed in accordance with the degree of opening (angle) of the fixed blades 23, which makes it to possible to adjust the powder fineness for sorting.

Note that the bottom end of the cone 21 serves as a cone exit 25 from which the coarse particles sorted by the fixed-type sorter 20 are supplied onto the grinding table 12.

Because the fixed-type sorter 20 is inferior in terms of sorting precision in a coarse particle region, and an increased amount of coarse particles (coarse particles whose approximate sizes exceed 100 mesh, which adversely affect combustibility) is contained in the pulverized coal, this causes uncombusted components contained in combustion exhaust gas expelled from the boiler to increase.

In the fixed-type sorter 20, the solid-gas two-phase flow that passes through between adjacent fixed blades 23 from the fixed-blade entrance windows 22 centrifugally sorts pulverized coal particles into coarse particles and fine powder by means of a spiral flow. Subsequently, the fine powder that has a small particle size and low weight is swirled up by being carried by a reverse upward flow from below the cone 21, enters the inner side of the inner cylinder 24 from below the inner cylinder 24, and flows out to the exterior of the vertical roller mill 10 from the pulverized-coal exit 16. On the other hand, because the coarse particles having large particle sizes that have been centrifugally separated are heavy and cannot be carried by the flow entering the inner side of the inner cylinder 24 from below the inner cylinder 24, they reach the inner wall of the cone 21 and fall downward along the inner-wall surface of the cone 21 due to gravity. The coarse particles eventually fall onto the grinding table 12, to be ground again, from the cone exit 25 provided as an opening at the center of the lower portion of the cone 21.

In the related art with regard to vertical roller mills provided with a fixed-type sorter, in order to enhance the sorting capability for ground pulverized coal, it has been proposed to modify flat-plate fixed blades into wave-shaped vanes. With the wave-shaped vanes, even if coarse coal particles flow in from all entry angles when a mixed airflow spiraling upward together with primary air is taken into the spaces between the waved-shaped vanes of a fixed-type sorter, because collisions occur at airflow colliding portions of the wave-shaped vanes and sorting is performed, the sorting capability of the fixed-type sorter is enhanced (for example, Patent Literature 1).

In addition, with rotating-type sorters that have a high sorting capability, in order to further enhance the sorting capability thereof, two stages of rotating blades are disposed in the direction of the rotation axis, and lower-stage blades are inclined with respect to an outer circumferential wall of a rotor, or pivoting portions that can freely pivot are provided at tip portions of the rotating blades (for example, Patent Literature 2).

CITATION LIST

Patent Literature

{PTL 1} Japanese Unexamined Patent Application, Publication No. Hei 10-230181

{PTL 2} Japanese Unexamined Patent Application, Publication No. Hei 2-26682

SUMMARY OF INVENTION

Technical Problem

As described above, with the fixed-type sorter 20 of the vertical roller mill 10, ground pulverized coal is sorted into coarse particles and fine powder by means of centrifugal force; however, because the centrifugal effect on coarse powder close to the product particle size (particle size between coarse particles and fine particles, that is, particle size of about 150 μm, which is the source of uncombusted components) is weak, a portion thereof flows toward the center close to the inner cylinder 24 due to fluctuations in the solid-gas two-phase flow and so forth, which results in a tendency to spiral and fall near the inner cylinder 24. Because of this, the probability of the coarse powder being mixed into the reverse upward flow of fine powder increases, and there is a problem in that the sorting efficiency deteriorates due to an increased amount of coarse powder that gets mixed into the product pulverized coal.

On the other hand, with the fixed-type sorter 20, the powder fineness is adjusted and set by adjusting the degree of opening of the fixed blades 23. In other words, the mill is operated such that the powder fineness is increased by increasing the centrifugal force by reducing the degree of opening (increasing the inclination angle) of the fixed blades 23, and, in contrast, the powder fineness is decreased by reducing the centrifugal force by increasing the degree of opening (reducing the inclination angle) of the fixed blades 23. When the powder fineness is decreased by increasing the degree of opening of the fixed blades 23, centrifugal sorting is not sufficient for coarse powder passing over the fixed blades 23, and therefore, because the coarse powder is more likely to flow toward the center together with the fine powder to be swirled up by the reverse upward flow, the deterioration of the sorting precision increases.

Depending on the degree of opening of the fixed blades 23, a portion of the coarse particles that have flowed toward the center collides with the inner cylinder 24 and floats between the fixed blades 23 and the inner cylinder 24 by being rebounded therefrom or falls down along a side surface of the inner cylinder 24, and therefore, this causes the sorting precision to deteriorate.

In addition, when the degree of opening of the fixed blades 23 is reduced, a portion of the coarse particles exits from the flow, collides with the fixed blades 23, and rebounds therefrom, thus following an irregular track. Such a behavior of the coarse particles is undesirable because the proportion of the coarse particles mixed into the product pulverized coal increases, which results in a further deterioration of the sorting precision.

In addition, when the coarse particles rise from the lower portion of the vertical roller mill 10 and enter the fixed-type sorter 20, the coarse particles flow toward the fixed blades 23 by drifting to the upper portion of the vertical roller mill 10 due to an inertial force. In other words, because the coarse particles tend to drift to the top side of the fixed blades 23 when flowing thereto, a region with a high particle concentration (density) is formed in the upper portion of the vertical roller mill 10 (at the upper portions of the fixed blades 23), and there is a problem in that the deterioration of the sorting efficiency described above is further worsened due to collision, interference, and aggregation of the particles in this region.

The present invention has been conceived in light of the circumstances described above, and an object thereof is to provide a vertical roller mill provided with a fixed-type sorter that is capable of reducing a coarse-particle proportion (proportion of coarse particles whose approximate sizes exceed 100 mesh, which adversely affect combustibility) in product pulverized coal.

Solution to Problem

In order to solve the problems described above, a vertical roller mill of the present invention employs the following solutions.

Specifically, a vertical roller mill according to the present invention is a vertical roller mill provided in a casing, including a fixed-type cyclone sorter that causes fine powder having a small particle size contained in a solid-gas two-phase flow, in which powder produced by grinding a solid is transported by means of an airflow, to externally flow out by applying sorting based on a centrifugal force, wherein the fixed-type sorter includes a conical member in which a narrow tip portion is positioned at the bottom; a fixed-blade entrance window provided in the conical member as an opening through which the solid-gas two-phase flow is introduced into the interior of the conical member; a flat plate-like fixed blade that is attached on the inner side of the conical member near the fixed-blade entrance window and that causes the solid-gas two-phase flow to spiral; an inner cylinder that is provided at an axial center of the conical member and into which the fine powder is guided from the bottom end thereof toward the top end thereof by means of spiraling of the solid-gas two-phase flow; and a fine-powder exit through which the fine powder guided to the top end of the inner cylinder is guided outside the conical member, wherein the fixed blade is bent at a tip portion of the fixed blade so as to increase a downward flow of the solid-gas two-phase flow guided into the interior of the conical member from the fixed-blade entrance window.

In the fixed blade, the tip portion thereof is bent so as to increase the downward flow of the solid-gas two-phase flow guided into the interior of the conical member. By doing so, the downward velocity component is increased for the solid-gas two-phase flow guided into the interior of the conical member, and, the greater the particle size and the greater the weight thereof, the more the coarse powder contained in the fine powder in the solid-gas two-phase flow flows downward. Accordingly, of the coarse powder that has flowed into the inner side of the conical member from the fixed-blade entrance window, the amount of coarse powder that is swirled up by a reverse upward flow is reduced. Therefore, the sorting precision of the vertical roller mill can be enhanced.

Furthermore, the fixed blades may be bent along a bending line that connects a top-edge bend starting point at the top edge thereof having a flat plate-like form and a bottom-edge bend starting point at the bottom edge thereof having the flat plate-like form; and the bottom-end bend starting point may be positioned closer to the axial center of the conical member than the top-edge bend starting point is.

The fixed blade that is bent along the bending line, which connects the top-edge bend starting point having the flat plate-like form and the bottom-edge bend starting point positioned closer to the axial center of the conical member than the top-edge bend starting point is, is employed. By doing so, the velocity component can be increased downward for the flow of the solid-gas two-phase flow guided into the interior of the conical member from the fixed-blade entrance window. Accordingly, the greater the particle size and the greater the weight thereof, the more the coarse powder contained in the fine powder in the solid-gas two-phase flow flows downward, and, of the coarse powder that has flowed toward the axial center of the conical member from the fixed-blade entrance window, the amount thereof that is swirled up by the reverse upward flow is reduced. Therefore, the sorting precision of the vertical roller mill can be enhanced.

Furthermore, the top-edge bend starting point may be at a position of 0.2 or greater but 0.3 or less from the fixed-blade entrance window relative to the total length of the top edge having the flat plate-like form, and the bottom-edge bend starting point may be at a position of 0.4 or greater but 0.6 or less from the fixed-blade entrance window relative to the total length of the bottom edge having the flat plate-like form.

Bending is performed by providing the top-edge bend starting point at a position of 0.2 or greater but 0.3 or less from the fixed-blade entrance window relative to the total length of the top edge having the flat plate-like form and by providing the bottom-edge bend starting point at a position of 0.4 or greater but 0.6 or less from the fixed-blade entrance window relative to the total length of the bottom edge having the flat plate-like form. Accordingly, the velocity component can be further increased in the downward direction for the flow of the solid-gas two-phase flow. Therefore, the sorting precision of the vertical roller mill can be further enhanced.

Note that it is preferable that the top-edge bend starting point be at a position of 0.24 from the fixed-blade entrance window relative to the total length of the top edge having the flat plate-like form and the bottom-edge bend starting point be at a position of 0.50 from the fixed-blade entrance window relative to the total length of the bottom edge having the flat plate-like form.

In addition, a line that connects a bottom-edge tip portion of the fixed blade and the bottom-edge bend starting point may form an angle of 10° or greater but 30° or less with respect to a line that extends in a radial direction from the fixed-blade entrance window toward the axial center of the conical member; and a line that connects a top-edge tip portion of the fixed blade and the top-edge bend starting point may form an angle of 5° or greater but 25° or less with respect to a line that connects the bottom-edge tip portion of the fixed blade and the bottom-edge bend starting point.

Bending is performed so that an angle between the line connecting the top-edge bend starting point and the top-edge tip portion and the line connecting the bottom-edge bend starting point and the bottom-edge tip portion is 5° or greater but 25° or less, and an angle between the line connecting the bottom-edge bend starting point and the bottom-edge tip portion and the line extending from the fixed-blade entrance window in the radial direction toward the axial center of the conical member is 10° or greater but 30° or less. Accordingly, the velocity component can be increased in the downward direction for the flow of the solid-gas two-phase flow. Therefore, the sorting precision of the vertical roller mill can be further enhanced.

Note that it is more preferable that the angle between the line connecting the top-edge bend starting point and the top-edge tip portion and the line connecting the bottom-edge bend starting point and the bottom-edge tip portion be 10° or greater but 20° or less, and it is more further preferable that the angle between the line connecting the bottom-edge bend starting point and the bottom-edge tip portion and the line extending from the fixed-blade entrance window in the radial direction toward the axial center of the conical member be 15° or greater but 25° or less.

In addition, the fixed blade may be bent from the fixed-blade entrance window toward the axial center of the conical member by being divided into multiple stages.

The fixed blade that is bent from the fixed-blade entrance window toward the axial center of the conical member by being divided into multiple stages is employed.

Accordingly, as compared with a case in which the fixed blade is bent in one stage, the velocity component can be increased in the downward direction for the flow of the solid-gas two-phase flow. Therefore, the sorting precision of the vertical roller mill can be further enhanced.

Advantageous Effects of Invention

With the present invention, a tip portion of a fixed blade is bent so as to increase a downward flow of a solid-gas two-phase flow guided into the interior of a conical member. By doing so, the downward velocity component is increased for the solid-gas two-phase flow guided into the interior of the conical member, and, the greater the particle size and the greater the weight thereof, the more the coarse powder contained in powder in the solid-gas two-phase flow flows downward. Accordingly, of the coarse powder that has flowed into the inner side of the conical member from a fixed-blade entrance window, the amount of the coarse powder that is swirled up in a reverse upward flow is reduced. Therefore, the sorting precision of a vertical roller mill can be enhanced.

BRIEF DESCRIPTION OF DRAWINGS

FIG. 4 is a table showing the relationship between the proportion of coarse particles of 300 μm or larger and individual bending starting points in the total length of the fixed blade, as well as inclination angles thereof.

FIG. 5 is a table showing the relationship between the proportion of fine particles of 75 μm or smaller and the individual bending starting points in the total length of the fixed blade, as well as the inclination angles thereof.

DESCRIPTION OF EMBODIMENTS

An embodiment of a vertical roller mill according to the present invention will be described below based on the drawings.

Figure 9:
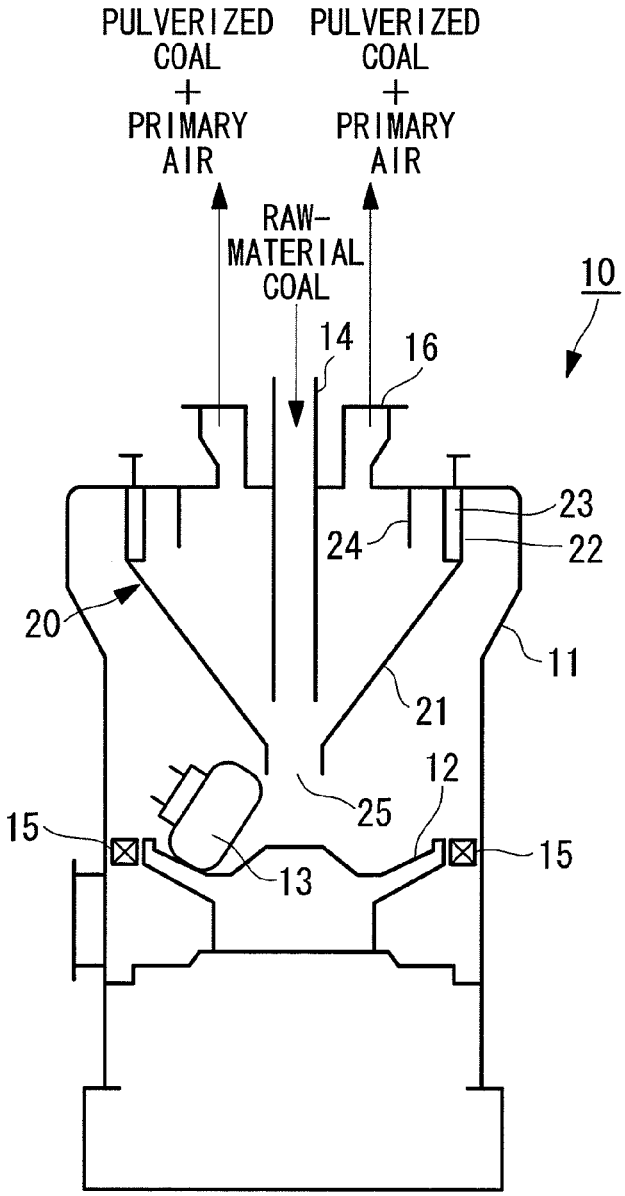
FIG. 9 PRIOR ART
FIG. 9 is a longitudinal sectional view showing, in outline, the configuration of a vertical roller mill.
Figure 10:
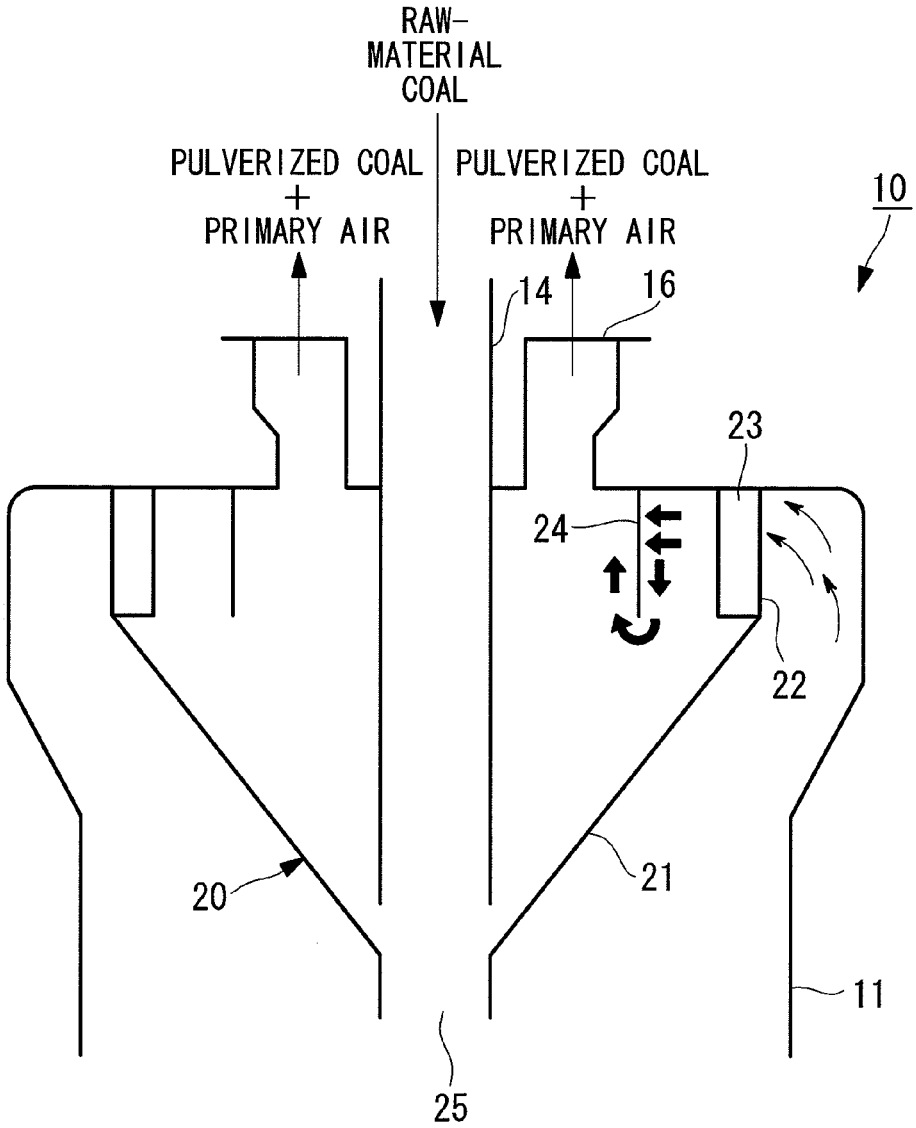
FIG. 10 PRIOR ART
FIG. 10 is a longitudinal sectional view showing the configuration of a conventional fixed-type sorter.

A vertical roller mill 10 shown in FIG. 9 produces pulverized coal that is used as, for example, fuel for a pulverized-coal-fired boiler (not shown). The vertical roller mill 10 grinds raw-material coal into pulverized coal and sorts the gravitationally-sorted pulverized coal by means of a fixed-type sorter 20. By doing so, product pulverized coal that has been sorted by passing through the fixed-type sorter 20 is transported, by means of an airflow of primary air, to the pulverized-coal-fired boiler from a pulverized-coal exit (fine-powder exit) 16, which is provided at the upper portion of the vertical roller mill 10, in the form of pulverized-coal fuel having a desired powder fineness.

Note that the configuration of the vertical roller mill 10 according to this embodiment is the same as that of the one in the related art described above, except for the configuration of the fixed-type sorter 20 described later, and therefore, a detailed description thereof will be omitted.

The vertical roller mill 10 according to the present invention is provided with, at the upper portion of a casing 11, a fixed-type cyclone sorter 20 that sorts pulverized coal having small particle sizes by means of a centrifugal force and makes it flow out to the pulverized-coal-fired boiler (exterior) by causing a solid-gas two-phase flow (pulverized coal and primary air) that transports, by means of an airflow, the pulverized coal (powder), which is ground raw-material coal (solid), to pass therethrough. The fixed-type sorter 20 is configured to introduce the solid-gas two-phase flow into the interior of the cone 21 from fixed-blade entrance windows 22 provided as openings in the cone (conical member) 21, to cause the solid-gas two-phase flow to spiral by means of fixed blades 23 attached to the inner side of the fixed-blade entrance windows 22, and to make low-weight pulverized coal having small particle sizes pass through the interior of the inner cylinder 24 from the bottom end of the inner cylinder 24 provided on the inner side of the cone 21 so that it flows out to the exterior of the cone 21 from a pulverized-coal exit 16 provided at the top end of the inner cylinder 24.

In other words, pulverized coal smaller than a desired particle size is carried and sorted by a reverse upward flow that rises through the bottom end of the inner cylinder 24 installed in the fixed-type sorter 20 and flows out by passing through the pulverized-coal exit 16 provided as an opening at the upper portion thereof. This pulverized coal is supplied to the pulverized-coal-fired boiler (not shown) as product pulverized coal (fuel pulverized coal) from the fixed-type sorter 20 and the vertical roller mill 10.

First Embodiment

Figure 1:
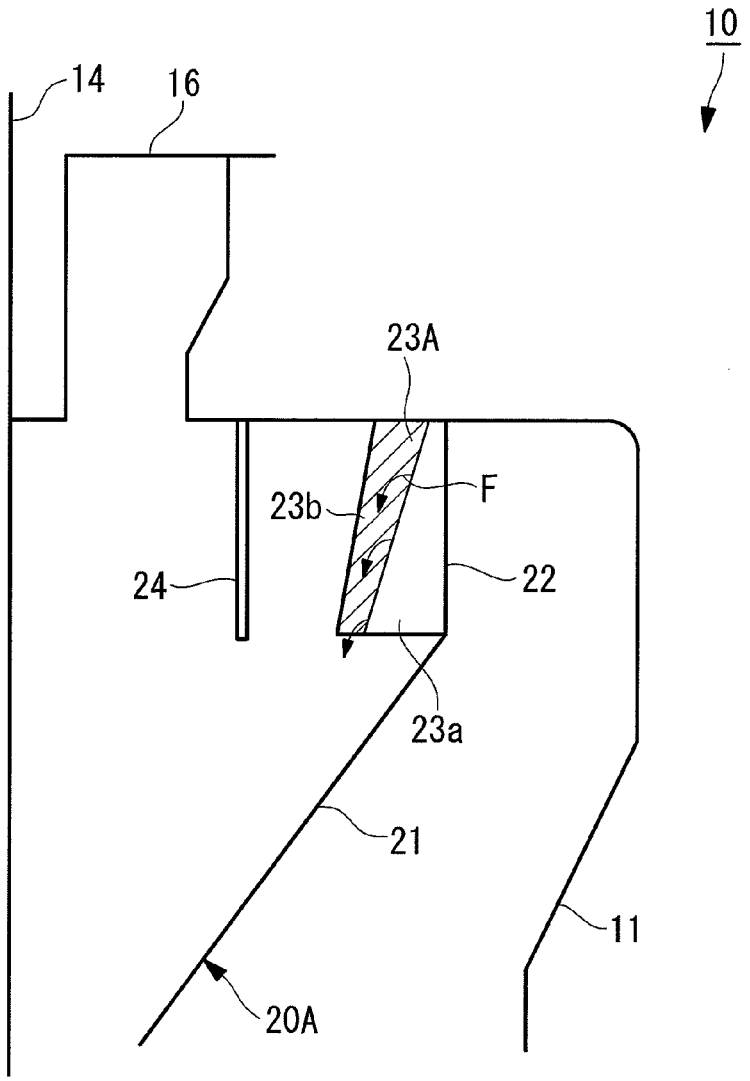
FIG. 1 is a longitudinal sectional view of a fixed-type sorter of a vertical roller mill according to a first embodiment.

In this embodiment, a fixed blade 23A shown in FIG. 1 is employed instead of the fixed blade 23 described above. The fixed blade 23A is provided with a fixed-blade base portion 23*a*, which turns the solid-gas two-phase flow that flows into the interior of the cone 21 from the fixed-blade entrance window 22 into a spiral flow, and a fixed-blade tip portion 23*b*, which increases the downward velocity component of the spiral flow.

A fixed-type sorter 20A is provided with the cone 21 and the concentric inner cylinder 24 disposed inside the cone 21 at a predetermined distance therefrom, thus forming a double cylinder configuration. At the inner side (axial center side) of the inner cylinder 24, the pulverized-coal exit 16 from which sorted product pulverized coal flows out is provided as an opening at the upper portion of the cone 21. The cone 21 is a conical member whose narrow tip portion is positioned at the bottom in the fixed-type sorter 20A. A cone exit 25 (see FIG. 9) from which recovered coarse particles drop onto the grinding table 12 (see FIG. 9) is provided as an opening at the lower portion of the cone 21.

At the upper portion of the cone 21, numerous fixed-blade entrance windows 22 are provided as openings at equal intervals in the circumferential direction. The fixed-blade entrance windows 22 are opening portions provided so as to penetrate through the wall surface that forms the cone 21 and serve as entrances and flow paths where the solid-gas two-phase flow, which transports the pulverized coal by means of an airflow of primary air, passes through to flow into the interior of the cone 21. The direction of the solid-gas two-phase flow that flows in from the fixed-blade entrance windows 22 is changed by substantially 90° from an upward flow that transports, by means of an airflow, the pulverized coal ground on the grinding table 12 disposed at the lower portion of the casing 11. In addition, the fixed blades 23A are attached to the inner wall of the cone 21 at positions corresponding to the individual fixed-blade entrance windows 22.

Figure 2A:
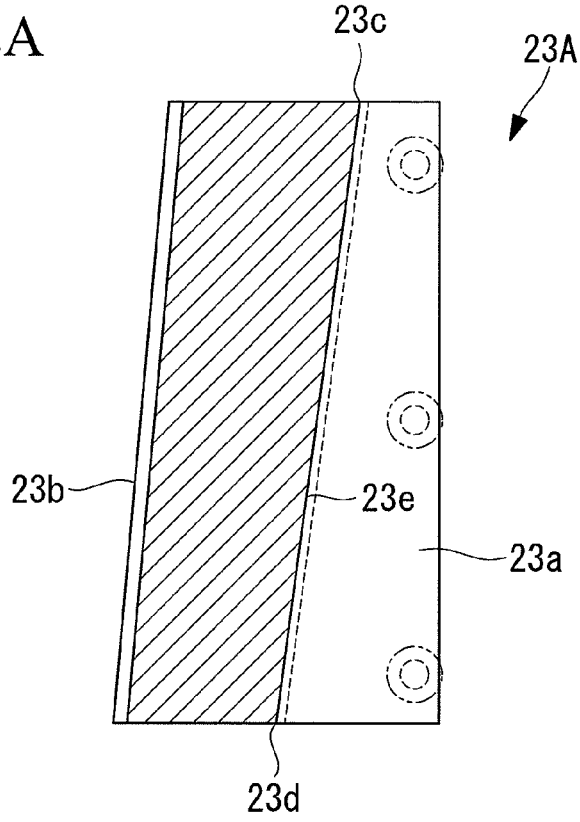
FIG. 2A is a partially enlarged front view of a fixed blade shown in FIG. 1.
Figure 2B:
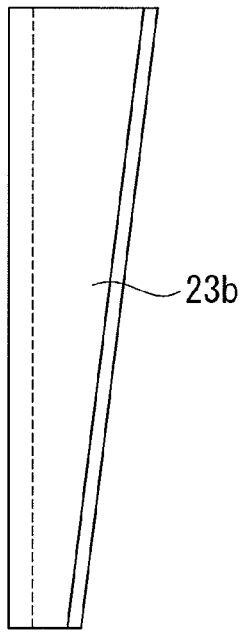
FIG. 2B is a partially enlarged left side view of the fixed blade shown in FIG. 1.
Figure 2C:
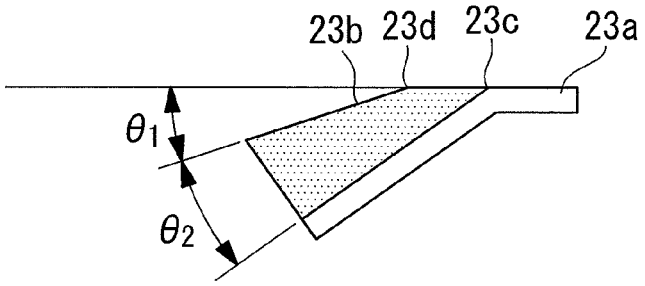
FIG. 2C is a partially enlarged top view of the fixed blade shown in FIG. 1.

FIGS. 2A to 2C show an enlarged view of the fixed blade 23A shown in FIG. 1.

FIG. 2A shows a front view of the fixed blade, FIG. 2B shows a left side view of the fixed blade, and FIG. 2C shows a top view of the fixed blade.

The fixed blade 23A is provided on the inner side of the cone 21 (see FIG. 1) near the fixed-blade entrance window 22. The fixed blade 23A has a shape in which a portion of a flat plate-like form is bent. The fixed blade 23A is bent in one stage in the radial direction from the fixed-blade entrance window 22 toward the axial center of the cone 21. The fixed blade 23A that is divided in two by being bent is formed of the fixed-blade base portion 23*a*, which is closer to the fixed-blade entrance window 22, and the fixed-blade tip portion (tip portion) 23*b*, which is closer to the axial center of the cone 21.

The fixed blade 23A is bent at a bending line 23*e* that connects a top-edge bending starting point (top-edge bend starting point) 23*c* provided at the top edge (upper side of the cone 21) of the flat plate-like form before bending and a bottom-edge bending starting point (bottom-edge bend starting point) 23*d* provided at the bottom edge (lower side of the cone 21) thereof. The bottom-edge bending starting point 23*d* is provided so as to be positioned closer to the axial center of the cone 21 than the top-edge bending starting point 23*c*.

Because the bottom-edge bending starting point 23*d* is provided so as to be positioned closer to the axial center of the cone 21 than the top-edge bending starting point 23*c*, the fixed-blade tip portion 23*b* of the fixed blade 23A is bent so as to form a trapezoidal form when viewed from the left side, as shown in FIG. 2B. By doing so, the downward flow of the solid-gas two-phase flow that has been caused to spiral by the fixed-blade base portion 23*a* is increased by the fixed-blade tip portion 23*b*.

In order to cause the solid-gas two-phase flow to spiral, the individual fixed-blade base portions 23*a* of the fixed-blades 23A are provided at the inner wall of the cone 21 so as to have the same inclination angle in the same direction. By providing the fixed-blade base portions 23*a* having the inclination angle, the solid-gas two-phase flow that flows in from the fixed-blade entrance windows 22 (see FIG. 1) is prevented from becoming a flow toward the axial center, which is substantially perpendicular to the outer wall of the inner cylinder 24. Specifically, by changing the direction of the velocity component of the flow of the solid-gas two-phase flow in the horizontal direction in accordance with the inclination angle, a flow is formed that spirals in the circumferential direction in a space formed between the inner wall of the cone 21 and the outer wall of the inner cylinder 24.

Furthermore, because the fixed-blade tip portion 23*b* that increases the downward flow of the solid-gas two-phase flow, which flows into the interior of the cone 21, is provided at the tip of the fixed blade 23A, the direction of the rising flow is changed so as to be more in the downward direction than in the substantially horizontal direction. Specifically, because the fixed-blade tip portion 23*b* guides the solid-gas two-phase flow that has passed over the fixed-blade base portion 23*b* so that the direction thereof is forced to change downward, as shown by an arrow F in the figure in FIG. 1, the downward velocity component is increased for the solid-gas two-phase flow that has been guided by the fixed-blade tip portion 23*b* to flow into the interior of the cone 21. Therefore, the velocity component that causes the solid-gas two-phase flow that has flowed into the interior of the cone 21 to move toward the axial center of the inner cylinder 24 so as to be substantially perpendicular to the outer wall thereof is weakened, and is decreased also in the vertical direction due to the fixed-blade tip portion 23*b* in addition to the horizontal direction due to the fixed-blade base portion 23*a*. Note that, in the illustrated configuration example, the solid-gas two-phase flow in FIG. 1 forms a clockwise spiral flow. In other words, the fixed-blade tip portion 23*b* is bent in the flow direction of the clockwise spiral flow.

By increasing the downward flow of the solid-gas two-phase flow that passes over the fixed blades 23A, the probability of coarse powder having a particularly large weight to directly flowing downward increases, which decreases the amount of coarse powder that flows toward the axial center of the fixed-type sorter 20A where the inner cylinder 24 and the pulverized-coal exit 16 exist. As a result, because the amount of coarse powder contained in the solid-gas two-phase flow that is swirled up together with product pulverized coal by the reverse upward flow, which flows out from the fixed-type sorter 20A, is reduced, the sorting precision of the fixed-type sorter 20A is enhanced.

Here, the positions of the top-edge bending starting point 23*c* and the bottom-edge bending starting point 23*d* will be described by using FIGS. 3 to 7.

Figure 3:
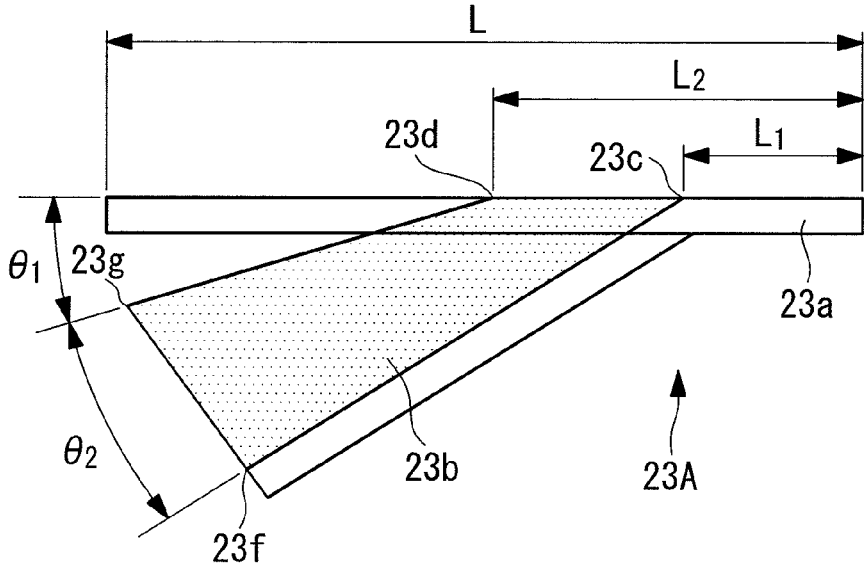
FIG. 3 is a schematic diagram showing a bending position of the fixed blade.

FIG. 3 shows a schematic view of the fixed blade 23A that is bent in one stage.

For the case in which the fixed blade 23A is not bent, that is, in the case of the flat plate-like form, the total length of the top edge or the bottom edge thereof is assumed to be L, when the fixed blade 23A is directed toward the axial center of the cone 21 (see FIG. 1) from the fixed-blade entrance window 22 (see FIG. 1). The length from the fixed-blade entrance window 22 to the top-edge bending starting point 23*c* is assumed to be L1, and the length from the fixed-blade entrance window 22 to the bottom-edge bending starting point 23*d* is assumed to be L2.

In addition, an inclination angle formed by a fixed-blade tip-side bottom edge (not shown) that connects, in the extending direction thereof, the bottom-edge bending starting point 23*d* and an end portion (herein after referred to as "bottom-edge tip portion") 23*g* of the bottom edge of the fixed blade 23A with respect to the extension line of the top edge of the fixed blade 23A when it is not bent (line extending from the fixed-blade entrance window 22 in the radial direction toward the axial center of the cone 21) is assumed to be θ1. In addition, an inclination angle formed by a fixed-blade tip-side top edge (not shown) that connects, in the extending direction thereof, the top-edge bending starting point 23*c* and an end portion (herein after referred to as "top-edge tip portion") 23*f* of the top edge of the fixed blade 23A with respect to the fixed-blade tip-side bottom edge is assumed to be θ2.

FIGS. 4 and 5 show the relationship between the sorting capability and these parameters L, L1, L2, θ1, and θ2.

FIG. 4 shows the proportion of coarse particles of 300 μm or larger remaining on a 50 mesh for the case in which the fixed blade 23A is not bent (conventional case). Furthermore, for the case in which the fixed blade 23A is bent, FIG. 4 shows a comparison of L1 and L2 relative to L (the total length of the fixed blades 23A), as well as comparisons of the cases in which the inclination angle θ1 formed by L and the fixed-blade tip-side bottom edge and the inclination angle θ2 formed by the fixed-blade tip-side bottom edge and the fixed-blade tip-side top edge are changed.

FIG. 5 shows the proportion of fine particles of 75 μm or smaller that have passed through a 200 mesh for the case in which the fixed blade 23A is not bent (conventional case). Furthermore, for the case in which the fixed blade 23A is bent, FIG. 5 shows a comparison of L1 and L2 relative to L, as well as comparisons of the cases in which the inclination angle θ1 formed by L and the fixed-blade tip-side bottom edge and the inclination angle θ2 formed by the fixed-blade tip-side bottom edge and the fixed-blade tip-side top edge are changed.

Figure 6:
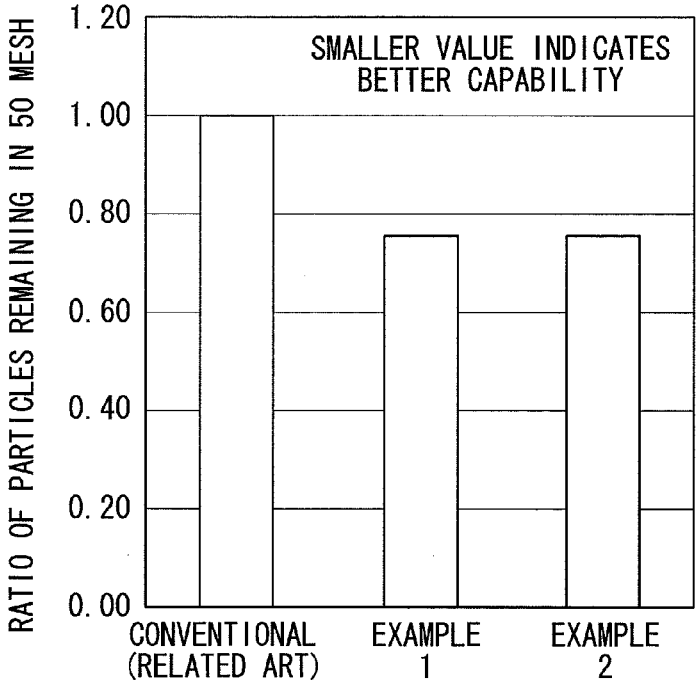
FIG. 6 is a graph based on the table in FIG. 4.

FIG. 6 shows the conventional case, Example 1, and Example 2 shown in FIG. 4 in the form of a graph.

As shown in FIG. 6, the sorting precision (proportion of the coarse particles of 300 μm or larger) is improved in the cases in which the fixed-blade tip portion 23*b* of the fixed blade 23A is bent as in Example 1 and Example 2 as compared with the conventional case.

Figure 7:
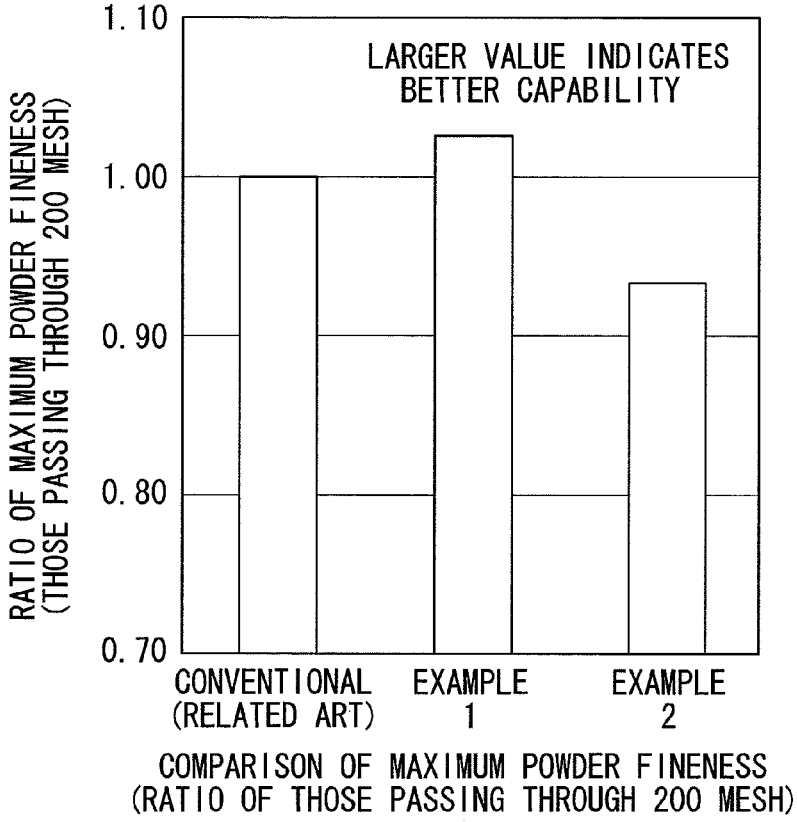
FIG. 7 is a graph based on the table in FIG. 5.

FIG. 7 shows the conventional case, Example 1, and Example 2 shown in FIG. 5 in the form of a graph.

As shown in FIG. 7, the maximum powder fineness (proportion of fine particles of 75 μm or smaller) is enhanced in Example 1 as compared with the conventional case and is decreased in Example 2a compared with the conventional case.

Furthermore, from FIGS. 6 and 7, it is understood that the sorting precision and the maximum powder fineness of Example 1 are improved as compared with the conventional case, and the sorting precision of Example 2 is improved as compared with the conventional case but the maximum powder fineness thereof is decreased.

Accordingly, the fixed-blade tip portion 23*b* of the fixed blade 23A should be bent so that the top-edge bending starting point 23*c* is provided at a position where L1/L is 0.2 or greater but 0.3 or less, the bottom-edge bending starting point 23*d* is provided at a position where L2/L is 0.4 or greater but 0.6 or less, so that the inclination angle θ1 formed by the fixed-blade tip-side bottom edge with respect to the radial direction toward the axial center of the cone 21 from the fixed-blade entrance window 22 is set to be 10° or greater but 30° or less, and so that the inclination angle θ2 between the fixed-blade tip-side bottom edge and the fixed-blade tip-side top edge is set to be 5° or greater but 25° or less.

Note that it is further preferable that the inclination angle θ1 be 15° or greater but 25° or less, and it is further preferable that the inclination angle θ2 be 10° or greater but 20° or less.

In addition, it is preferable that the top-edge bending starting point 23*c* be positioned where L1/L is 0.24 and the bottom-edge bending starting point 23*d* be positioned where L2/L is 0.50.

The vertical roller mill 10 according to this embodiment described above affords the following operational advantages.

The fixed-blade tip portion (tip portion) 23*b* of the fixed blade 23A is bent so as to increase the downward flow of the solid-gas two-phase flow guided into the interior of the cone (conical member) 21. By doing so, the velocity component can be increased in the downward direction for the flow of the solid-gas two-phase flow guided into the interior of the cone (conical member) 21, and, the greater the particle size and the greater the weight thereof, the more the coarse powder contained in the fine powder in the solid-gas two-phase flow flows downward inside the cone 21. Accordingly, of the coarse powder that has flowed into the inner side of the cone 21 from the fixed-blade entrance windows 22, the amount of coarse powder that is swirled up by the reverse upward flow is reduced. Therefore, the sorting precision of the vertical roller mill 10 can be enhanced.

The fixed blade 23A that is bent along the bending line 23*e*, which connects the top-edge bending point 23*c* (top-edge bend starting point) and the bottom-edge bending point 23*d* (bottom-edge bend starting point) positioned closer to the axial center of the cone 21 than the top-edge bending point 23*c*, is employed. By doing so, the velocity component can be increased in the downward direction for the flow of the solid-gas two-phase flow guided into the interior of the cone 21 from the fixed-blade entrance window 22. Accordingly, the greater the particle size and the greater the weight thereof, the more the coarse powder contained in the fine powder in the solid-gas two-phase flow flows downward, and, of the coarse powder that has flowed toward the axial center of the cone 21 from the fixed-blade entrance window 22, the amount thereof that is swirled up by the reverse upward flow is reduced. Therefore, the sorting precision of the vertical roller mill 10 can be enhanced.

The fixed blade 23A is bent by providing the top-edge bending point 23*c* thereof at a position of 0.2 or greater but 0.3 or less from the fixed-blade entrance window 22 relative to the total length L of the top edge in the flat plate-like form, and by providing the bottom-edge bending starting point 23*d* of the fixed blade 23A, on the bottom edge on the tip side thereof, at a position of 0.4 or greater but 0.6 or less from the fixed-blade entrance window 22 relative to the total length L of the bottom edge in the flat plate-like form. Accordingly, the velocity component can be further increased in the downward direction for the flow of the solid-gas two-phase flow. Therefore, the sorting precision of the vertical roller mill 10 can be further enhanced.

The fixed-blade tip portion 23*b* is bent so that the inclination angle θ1 between the fixed-blade tip-side bottom edge (the line connecting the bottom-edge bending starting point 23*d* and the bottom-edge tip portion 23*g*) and the line extending from the fixed-blade entrance window 22 in the radial direction toward the axial center of the cone 21 is 10° or greater but 30° or less, and the inclination angle θ2 between the fixed-blade tip-side top edge (the line connecting the top-edge bending starting point 23*c* and the top-edge tip portion 23*f*) and the fixed-blade tip-side bottom edge is 5° or greater but 25° or less. Accordingly, the velocity component can be increased in the downward direction for the flow of the solid-gas two-phase flow. Therefore, the sorting precision of the vertical roller mill 10 can be further enhanced.

Second Embodiment

A second embodiment of the present invention will be described below. A vertical roller mill of this embodiment differs from that of the first embodiment in that the fixed blades are bent in two stages, but other components are the same. Therefore, the same configuration and the same flow are indicated by the same reference signs, and descriptions thereof will be omitted.

Figure 8A:
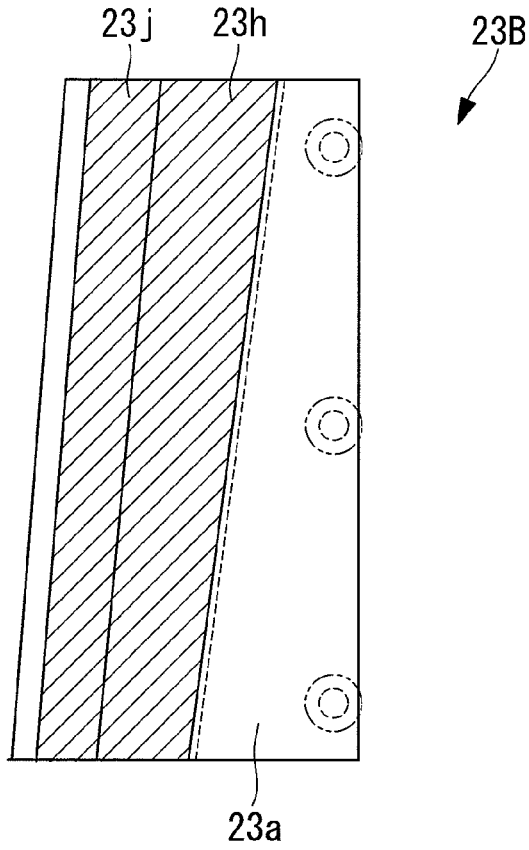
FIG. 8A is a partially enlarged front view of a fixed blade according to a second embodiment.
Figure 8B:
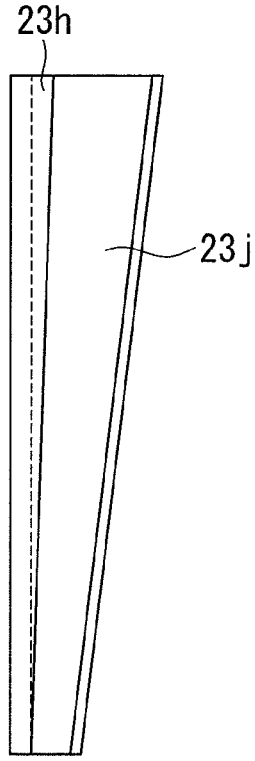
FIG. 8B is a partially enlarged left side view of the fixed blade according to the second embodiment.
Figure 8C:
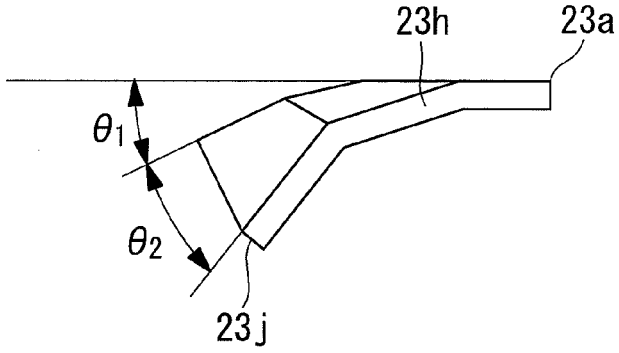
FIG. 8C is a partially enlarged top view of the fixed blade according to the second embodiment.

FIGS. 8A to 8C are enlarged views of a fixed-type sorter of a vertical roller mill according to the second embodiment of the present invention, where FIG. 8A shows a front view thereof, FIG. 8B shows a left side view thereof, and FIG. 8C shows a top view thereof.

A fixed blade 23B is formed of a fixed-blade base portion 23*a*, a first fixed-blade tip portion 23*h*, and a second fixed-blade tip portion 23*j*. The fixed blade 23B is bent from the fixed-blade base portion 23*a* in the radial direction toward the axial center of the cone (not shown) so as to be divided into two stages at the first fixed-blade tip portion 23*h* and the second fixed-blade tip portion 23*j* in sequence.

The vertical roller mill according to this embodiment described above affords the following operational advantages.

The fixed blade 23B, having the first fixed-blade tip portion 23*h* and the second fixed-blade tip portion 23*j*, that is bent from the fixed-blade entrance window (not shown) toward the axial center of the cone (conical member) so as to be divided into two stages (multiple stages) is employed. Accordingly, as compared with a case in which the fixed blade 23B is bent in one stage, the downward flow can be increased for the solid-gas two-phase flow. Therefore, the sorting precision of the vertical roller mill (not shown) can be further enhanced.

Note that, although the fixed blade in this embodiment has been described assuming that it is bent in two stages, the present invention is not limited thereto, and the fixed blade may be bent in two or more stages.

REFERENCE SIGNS LIST

10 vertical roller mill
11 casing
12 grinding table
13 grinding roller
14 coal feeding pipe
15 throat
16 pulverized-coal exit (fine powder exit)
20, 20A fixed-type sorter
21 cone (conical member)
22 fixed-blade entrance window
23A, 23B fixed blade
23*b* fixed-blade tip portion (tip portion)
23*c* top-edge bending starting point (top-edge bend starting point)
23*d* bottom-edge bending starting point (bottom-edge bend starting point)
23*e* bending line
23*f* top-edge tip portion
23*g* bottom-edge tip portion
23*h* first fixed-blade tip portion
23*j* second fixed-blade tip portion
24 inner cylinder
25 cone exit

The invention claimed is:

1. A vertical roller mill comprising:

a fixed cyclone sorter provided in a casing, which causes fine powder having a small particle size contained in a solid-gas two-phase flow, in which powder produced by grinding a solid is transported by means of an airflow, to externally flow out by applying sorting based on a centrifugal force, wherein the fixed cyclone sorter includes a conical member in which a narrow tip portion is positioned at the bottom;

a fixed-blade entrance window provided in the conical member as an opening through which the solid-gas two-phase flow is introduced into the interior of the conical member;

a flat plate fixed blade that is attached on the inner side of the conical member near the fixed-blade entrance window and that causes the solid-gas two-phase flow to spiral;

an inner cylinder that is provided at an axial center of the conical member and into which the fine powder is guided from the bottom end thereof toward the top end thereof by means of spiraling of the solid-gas two-phase flow; and a fine-powder exit through which the fine powder guided to the top end of the inner cylinder is guided outside the conical member, wherein the fixed blade is bent at a tip portion of the fixed blade so as to increase a downward flow of the solid-gas two-phase flow guided into the interior of the conical member from the fixed-blade entrance window;

the fixed blade is bent along a bending line that connects a top-edge bend starting point at the top edge thereof having a flat plate form and a bottom-edge bend starting point at the bottom edge thereof having the flat plate form; and the bottom-end bend starting point is positioned closer to the axial center of the conical member than the top-edge bend starting point is.

2. A vertical roller mill according to claim 1, wherein the top-edge bend starting point is at a position of 0.2 or greater but 0.3 or less from the fixed-blade entrance window relative to the total length of the top edge having the flat plate form, and the bottom-edge bend starting point is at a position of 0.4 or greater but 0.6 or less from the fixed-blade entrance window relative to the total length of the bottom edge having the flat plate form.

3. A vertical roller mill according to claim 1, wherein a line that connects a bottom-edge tip portion of the fixed blade and the bottom-edge bend starting point forms an angle of 10° or greater but 30° or less with respect to a line that extends in a radial direction from the fixed-blade entrance window toward the axial center of the conical member; and a line that connects a top-edge tip portion of the fixed blade and the top-edge bend starting point forms an angle of 5° or greater but 25° or less with respect to a line that connects the bottom-edge tip portion of the fixed blade and the bottom-edge bend starting point.

4. A vertical roller mill according to claim 1, wherein the fixed blade is bent from the fixed-blade entrance window toward the axial center of the conical member by being divided into multiple stages.

* * * * *